US006520614B2

(12) United States Patent
Kaneko

(10) Patent No.: US 6,520,614 B2
(45) Date of Patent: Feb. 18, 2003

(54) PRINTING-MEDIUM TYPE DISCRIMINATION DEVICE AND PRINTING APPARATUS

(75) Inventor: Kenichi Kaneko, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 18 days.

(21) Appl. No.: 09/767,827

(22) Filed: Jan. 24, 2001

(65) Prior Publication Data

US 2001/0026293 A1 Oct. 4, 2001

(30) Foreign Application Priority Data

Jan. 28, 2000 (JP) ..... 2000-020903

(51) Int. Cl.[7] ..... B41J 29/38; B41J 29/393
(52) U.S. Cl. ..... 347/14; 347/19
(58) Field of Search ..... 347/14, 19, 16

(56) References Cited

U.S. PATENT DOCUMENTS

| | | | | |
|---|---|---|---|---|
| 4,313,124 A | | 1/1982 | Hara | |
| 4,345,262 A | | 8/1982 | Shirato et al. | |
| 4,459,600 A | | 7/1984 | Sato et al. | |
| 4,463,359 A | | 7/1984 | Ayata et al. | |
| 4,558,333 A | | 12/1985 | Sugitani et al. | |
| 4,608,577 A | | 8/1986 | Hori | |
| 4,723,129 A | | 2/1988 | Endo et al. | |
| 4,740,796 A | | 4/1988 | Endo et al. | |
| 5,826,133 A | * | 10/1998 | Saito et al. | 399/2 |
| 6,040,923 A | * | 3/2000 | Takashimizu et al. | 358/498 |
| 6,097,497 A | * | 8/2000 | McGraw | 358/1.12 |
| 6,201,255 B1 | * | 3/2001 | Torchalski et al. | 250/559.4 |

FOREIGN PATENT DOCUMENTS

| | | |
|---|---|---|
| JP | 54-56847 | 5/1979 |
| JP | 59-123670 | 7/1984 |
| JP | 59-138461 | 8/1984 |
| JP | 60-71260 | 4/1985 |

* cited by examiner

*Primary Examiner*—Thinh Nguyen
(74) *Attorney, Agent, or Firm*—Fitzpatrick, Cella, Harper & Scinto

(57) ABSTRACT

There is provided a printing apparatus for performing printing on a printing medium with a capability of discriminating the type of printing medium on which the printing is to be executed, whereby various printing conditions can be properly selected and set up. Sensors for measuring the reflectances of a front side face, on which the printing will be performed, and of a back side face of the printing medium are provided and the type of printing medium is discriminated through the use of a difference value of the two reflectances and previously-measured standard values. The printing is executed on the printing medium that was discriminated in this way under proper printing conditions.

30 Claims, 4 Drawing Sheets

PRINTING-MEDIUM TYPE DISCRIMINATION DEVICE AND PRINTING APPARATUS

This application is based on patent application Ser. No. 2000-20903 filed Jan. 28, 2000 in Japan, the content of which is incorporated hereinto by reference.

BACKGROUND OF THE INVENTION

1. Field of the Invention

The present invention relates to a printing-medium type discrimination device and a printing apparatus that uses the device.

2. Description of the Related Art

In connection with a trend of printing apparatuses toward higher resolution in recent years, there has been adopted a method for rendering a variety of colors, for example, by depositing a plurality of printing agents each having a different color on the substantially same position of a printing medium. However, because of a relationship between a characteristic of the printing agent and the type of printing medium, there may be cases where a difference occurs between qualities of images formed on different printing media in performing the printing even under the same printing condition. For example, in ink jet printing apparatuses that use inks as the printing agents, a state how the ink penetrates into the printing medium differs depending on the type of printing medium because of the inherent characteristic of the ink; therefore even when the printing is executed by the same printing method and with the same ejection quantity, a large difference may occur in terms of the quality of images formed on the printing media.

Moreover, an ink jet printing apparatus that ejects a specific solvent for preventing bleeding of an ink on the printing medium cannot achieve an intended effect on printing mediums that have a coating layer on one face, and consequently printing on such printing media causes useless consumption of the inks, the solvent, and the printing media.

Therefore, it is highly desirable that various printing conditions, such as the type of ink to be used in the printing, the ejection quantity, the type of printing medium, etc. should be selected and set up properly in consideration of their mutual relationships.

However, since such selection is entrusted to each user in conventional printing, the user is forced to make a proper judgment. Further, with increasing types of printing medium, the user's judgment or selection for the printing may become more complicated.

With this view, there has been investigated a printing apparatus that can discriminate the type of printing medium loaded therein and select optimal printing conditions. More specifically, there is a printing apparatus that uses means for measuring the optical reflectance of the face of the printing medium with a reflection-type optical sensor as one method of acquiring information of the printing medium. Here, the reflection-type optical sensor is a sensor that can irradiate an object with light and can measure the amount of reflected light. That sensor can perform necessary discrimination through a process where the optical reflectance of the face on which the printing should be performed originally of the printing medium is measured beforehand for a plurality of printing media and the reflectance of the printing medium to be used for the printing is compared with those measured values However, since there exist printing media of different types that have substantially same reflectances, it is difficult for this method to discriminate all the types of the printing media correctly.

SUMMARY OF THE INVENTION

It is the object of the present invention to discriminate the type of printing medium with a high degree of accuracy and thereby various printing conditions can be selected and set up properly.

In a first aspect of the present invention, there is provided a printing-medium type discrimination device applied to a printing apparatus for performing printing on a printing medium, comprising:

means for acquiring information of both a front side face on which the printing will be executed and a back side face of the printing medium (i.e., two pieces of information); and means for discriminating the type of the printing medium through the use of the acquired two pieces of information.

The discriminating means may conduct discrimination through the use of reference values for the two pieces of information.

The discriminating means may conduct the discrimination through the use of reference values for the two pieces of information and a difference value between the two pieces of information.

The information acquisition means may have means for irradiating each of the faces of the printing medium with light and measuring the quantity of reflected light obtained therefrom.

The information acquisition means may have an image pickup device for reading respective patterns of the faces of the printing medium.

The information acquisition means may have means for measuring respective friction forces of the faces of the printing medium.

The information acquisition means may have means for reading inherent information that has been formed on one of the faces of the printing medium beforehand.

In a second aspect of the present invention, there is provided a printing medium that bears information concerning its own type on itself, wherein the information is provided at a position that can be read by means for acquiring information of both the front side face on which printing will be executed and the back side face of the printing medium.

In a third aspect of the present invention, there is provided a printing apparatus for performing printing on a printing medium by using a print head, comprising:

means for acquiring information of both a front side face on which the printing will be executed and a back side face of the printing medium;

means for discriminating the type of the printing medium through the use of the acquired two pieces of information; and means for executing the printing that is suited to the printing medium on which the printing is to be executed according to the discrimination of the discriminating means.

The printing execution means may have means for changing a specified print mode according to the discriminated printing medium type.

The printing apparatus according to the third aspect of the present invention may further comprise means for judging whether or not the printing medium is loaded In the state of the face on which the printing should be originally performed being reversed through the use of the two pieces of information when the printing-medium type discrimination means failed to conduct the discrimination.

The printing apparatus according to the third aspect of the present invention may further comprise means for giving the user predetermined information and halting the printing when the discriminating means judges the printing medium to be loaded in the state of the face on which the printing should be originally performed being reversed and means for continuing or halting the printing according to the user's instruction indicating whether the printing is to be continued or not, when the judgment regarding the state of the face on which the printing should be originally performed being reversed is not made.

In a fourth aspect of the present invention, there is provided a printing system, comprising:

a printing apparatus having means for acquiring information of both a front side face on which the printing will be executed and a back side face of a printing medium, means for discriminating the type of the printing medium through the use of the acquired two pieces of information, and means for executing the printing that is suited to the printing medium on which the printing is to be executed according to the discrimination of the discriminating means; and an image data supplying apparatus for supplying an image data to be printed to the printing apparatus.

In a fifth aspect of the present invention, there is provided a printing-medium type discrimination method applied to a printing apparatus for performing printing on a printing medium, comprising the steps of:

acquiring information of both a front side face on which the printing will be executed and a back side face of the printing medium; and discriminating the type of the printing medium through the use of the acquired two pieces of information.

In a sixth aspect of the present invention, there is provided a printing method for performing printing on a printing medium by using a print head, comprising the steps of:

acquiring information of both a front side face on which the printing will be executed and a back side face of the printing medium;

discriminating the type of the printing medium through the use of the acquired two pieces of information; and executing the printing that is suited to the printing medium on which the printing is to be executed according to the discrimination.

In a seventh aspect of the present invention, there is provided a printing method applied to a printing system comprising an image data supplying apparatus and a printing apparatus, the method comprising the steps of:

supplying an image data to be printed to the printing apparatus from the image data supplying apparatus;

acquiring information of both a front side face on which the printing will be executed and a back side face of a printing medium before printing of the image data;

discriminating the type of the printing medium through the use of the acquired two pieces of information; and executing the printing that is suited to the printing medium on which the printing is to be executed according to the discrimination.

In an eighth aspect of the present invention, there is provided a program for performing a printing-medium type discrimination method applied to a printing apparatus, the method comprising the steps of:

acquiring information of both a front side face on which the printing will be executed and a back side face of a printing medium; and discriminating the type of the printing medium through the use of the acquired two pieces of information.

In a ninth aspect of the present invention, there is provided a program for performing a printing method for executing a printing on a printing medium by using a print head, the method comprising the steps of;

acquiring information of both a front side face on which the printing will be executed and a back side face of the printing medium;

discriminating the type of the printing medium through the use of the acquired two pieces of information; and executing the printing that is suited to the printing medium on which the printing is to be executed according to the discrimination.

In a tenth aspect of the present invention, there is provided a program for performing a printing method applied to a printing system comprising an image data supplying apparatus and a printing apparatus, the method comprising the steps of:

supplying an image data to be printed to the printing apparatus from the image data supplying apparatus;

acquiring information of both a front side face on which the printing will be executed and a back side face of a printing medium before printing of the image data;

discriminating the type of the printing medium through the use of the acquired two pieces of information: and executing the printing that is suited to the printing medium on which the printing is to be executed according to the discrimination.

In any one of the above aspects of the present invention, an ink jet print head for ejecting an ink as a print agent to the printing medium may be used.

The ink jet print head may have an electrothermal transducer to generate a thermal energy for causing film boiling in the ink as an energy used to eject the ink.

The present invention as described above makes it possible for the printing apparatus: to discriminate the printing medium automatically with a high degree of accuracy; to perform the printing in a proper print mode; and to form an image with such image quality as is best suited to the printing medium, while eliminating the need for the user to change the setting intentionally, through furnishing of a function of automatically discriminating the type of printing medium, for example, by measuring the optical reflectances of a front side face and of a back side face of the printing medium, calculating the difference value of these reflectances, and comparing them with previously-measured reference values.

Incidentally, in this specification, a word "print" (or "record") refers to not only forming significant information, such as characters and figures, but also forming images, designs or patterns on printing medium and processing media, whether the information is significant or insignificant or whether it is visible so as to be perceived by humans.

The word "printing medium" include not only paper used in common printing apparatus, but cloth, plastic films, metal plates, glass, ceramics, wood, leather or any other material that can receive ink.

Further, the word "ink" should be interpreted in its wide sense as with the word "print" and refers to liquid that is applied to the printing medium to form images, designs or patterns, process the printing medium or process ink.

The above and other objects, features and advantages of the present invention will become more apparent from the following description of embodiments thereof taken in conjunction with the accompanying drawings.

DETAILED DESCRIPTION OF THE PREFERRED EMBODIMENTS

Figure 1:
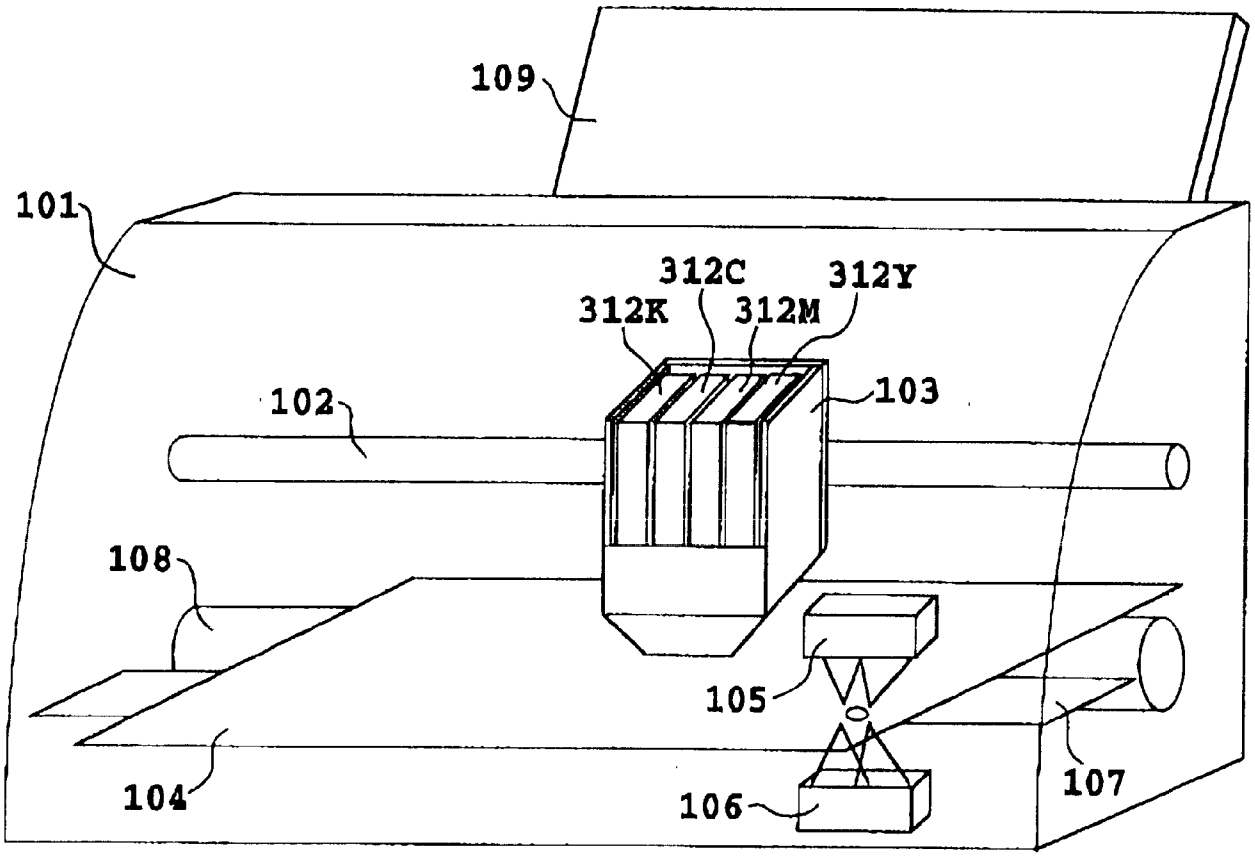
FIG. 1 is a schematic perspective view showing an example of configuration of an ink jet printer of a serial printer as a preferred printing apparatus to which the present invention is embodied or applied.

Hereafter, the present invention will be described in detail referring to the drawings.

First Embodiment

FIG. 1 is a schematic perspective view showing an example of configuration of an ink jet printer of a serial printer as a preferred printing apparatus to which the present invention is embodied or applied.

The printing apparatus 101 of FIG. 1 comprises, generally: a carriage 103 that conducts back-and-forth motion along main-scanning directions on a guide rail 102; a pair of reflection-type optical sensors 105 and 106 that are arranged facing to the front side and the back side of the printing medium 104, respectively, to conduct measurement; a platen 107 for controlling the printing medium 104 so as to be flat; a feed roller 108 for conveying the printing medium in a sub-scanning direction; and an automatic sheet feeder 109 for feeding the printing medium to a print position.

On the carriage 103 conducting the back-and-forth motion in the main-scanning directions, print heads 312K, 312C, 312M, and 312Y of a cartridge form that corresponds to a plurality of inks each having different color (for example, four colors of black (K), cyan(C), magenta (M), and yellow (Y)) are detachably mounted. Here, various types of print heads may be used. For example, one type of the print head may be an ink jet head cartridge comprising: an ink tank that accommodates the ink as the printing agent and that is detachably mounted on the cartridge main body; and a ejection portion hold by the cartridge main body. Further, that kind of cartridge may have a configuration such that the ink ejection portion is combined with the ink tank inseparably, or alternatively a configuration such that both members can be separated to allow the user replace only the ink tank independently with a new one when the residual quantity of the ink tank becomes zero.

Furthermore, the print head may have a configuration such that only the ejection portion is of a cartridge form and the ink is supplied from the ink tank provided at some different position of the apparatus through a tube etc. Moreover, for the ejection portion, the apparatus may use one that comprises an electrothermal transducer (ejection heater) for generating thermal energy that makes the ink develop film boiling in response to flow of electricity as an energy to be used to eject the ink.

Alternatively, the print head may be compatible with plural kinds of inks, each having different concentration of the same color, and a plurality of print heads may be used to correspond to different print densities.

Figure 2:
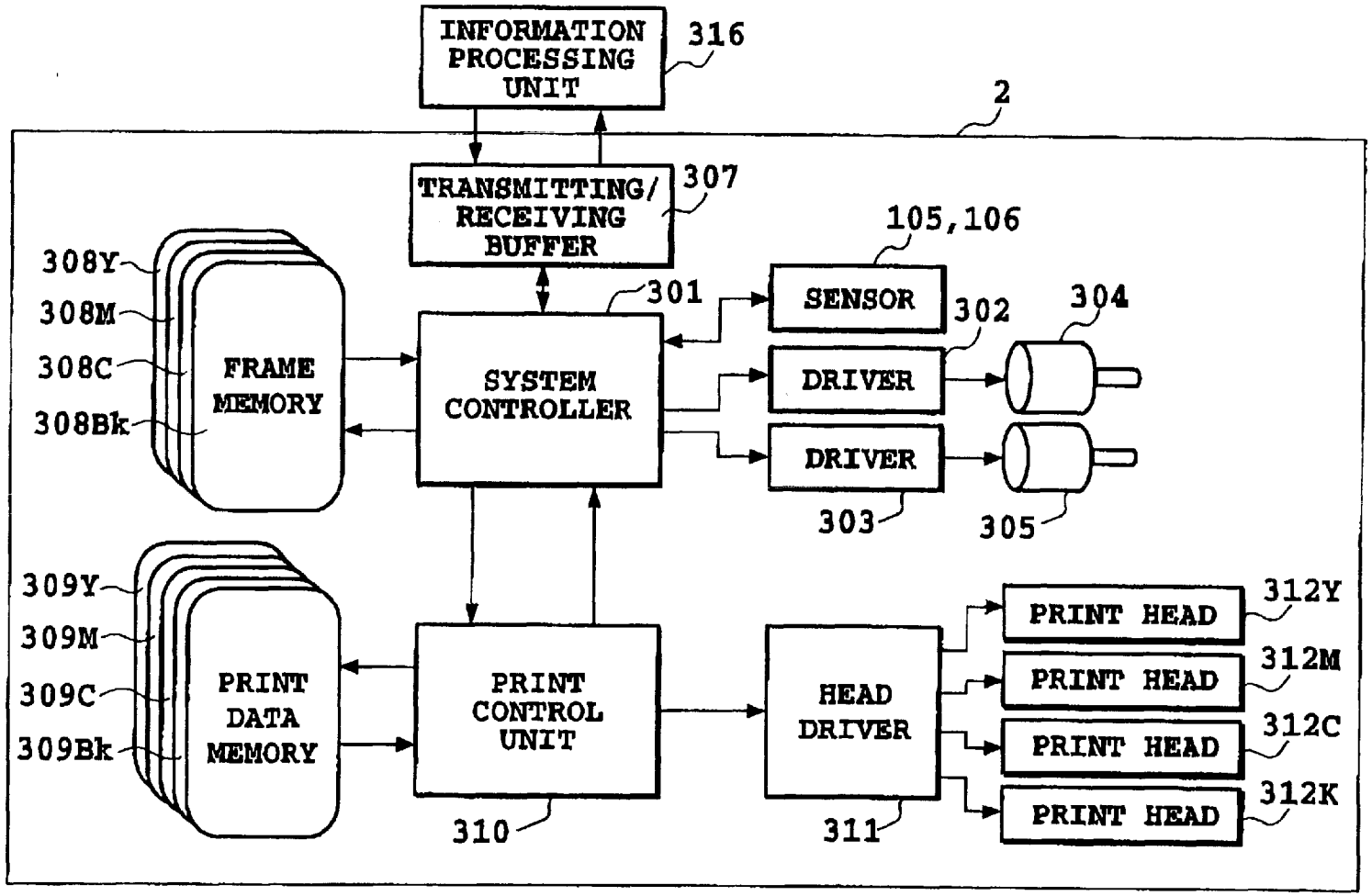
FIG. 2 is a block diagram showing an example of configuration of a control system of the apparatus shown in FIG. 1.

FIG. 2 is a block diagram showing an exemplary configuration of the control system of the printing apparatus described above.

In FIG. 2, denoted 301 is a system controller for controlling the whole printing apparatus 101, in which provided are: a CPU of a microprocessor form; a storage device (ROM) where fixed data, such as a control program corresponding to processing which will be described later referring to FIG. 4 etc., are stored; a storage device (RAM) that is used as a work area when the microprocessor conducts processing; and the like.

Denoted 302 is a driver which drives a motor 304 for making the carriage 103 travel, and similarly denoted 303 is a driver that drives a motor 305 for conveying the printing medium 104. That is, the motors 304 and 305 receive information, such as speed, traveling distance, etc., from corresponding drivers and conduct operations, respectively.

Denoted 307 is a transmitting/receiving buffer for storing required information that is sent to and received from an information processing unit 316 as a host equipment, such as print data, commands, statuses, etc., and serves to accumulate data until the system controller reads the data. Further, denoted 308 is a frame memory used for developing data which should be printed into image data and stores the image data that the system controller 301 develops according to the data read from the transmitting/receiving buffer 307. This frame memory 308 has a memory size necessary to perform the printing, and concretely in this embodiment, such that image data for one sheet of the printing medium can be stored. However, naturally the present invention is not limited to the size of this frame memory. Furthermore, denoted 309 is a memory for storing part of the print data equivalent to one line data when the print head is scanned and possesses a storage capacity corresponding to the number of ejection openings of the print head and the print density in the main-scanning direction.

Denoted 310 is a print control unit for controlling the drive of the ejection portion of the print head in response to instructions from the system controller 301, for example, controlling ejection frequency, the number of ejection, etc. of the ejection portion. Denoted 311 is a driver for driving the ejection portions of the print heads 312K, 312C, 312M, and 312Y through the control of the print control unit 310 to effect the ejection of the inks.

Further, denoted 313 is an operation panel of the printing apparatus 101 comprising an LCD or the like for conducting presentation of messages such as warnings to the user, a power supply switch, an on-line/off-line switch for the information processing unit 316, and a later-described key operated by the user for making the printing apparatus execute various functions.

For example, the user who wishes to perform creation, editing, etc. of the images (conceptually, this word is intended to include documents etc. besides images) by using an application software of the information processing unit 316 that takes a configuration of a computer, and to print this with the printing apparatus 101 is expected to select print quality, the type of printing medium, etc. when giving an instruction of initiating the printing. On the other hand, the image data that was created and edited is converted into a print command that is in conformity to the printing apparatus 101 by the printer driver of the information processing unit 316. In this print command, information such as printing resolution, the print mode, the type of printing medium, the print data, etc. are included. Then, the printing apparatus 101 decides a printing method and the ejection quantity according to the print mode specified in this print command.

Figure 3:
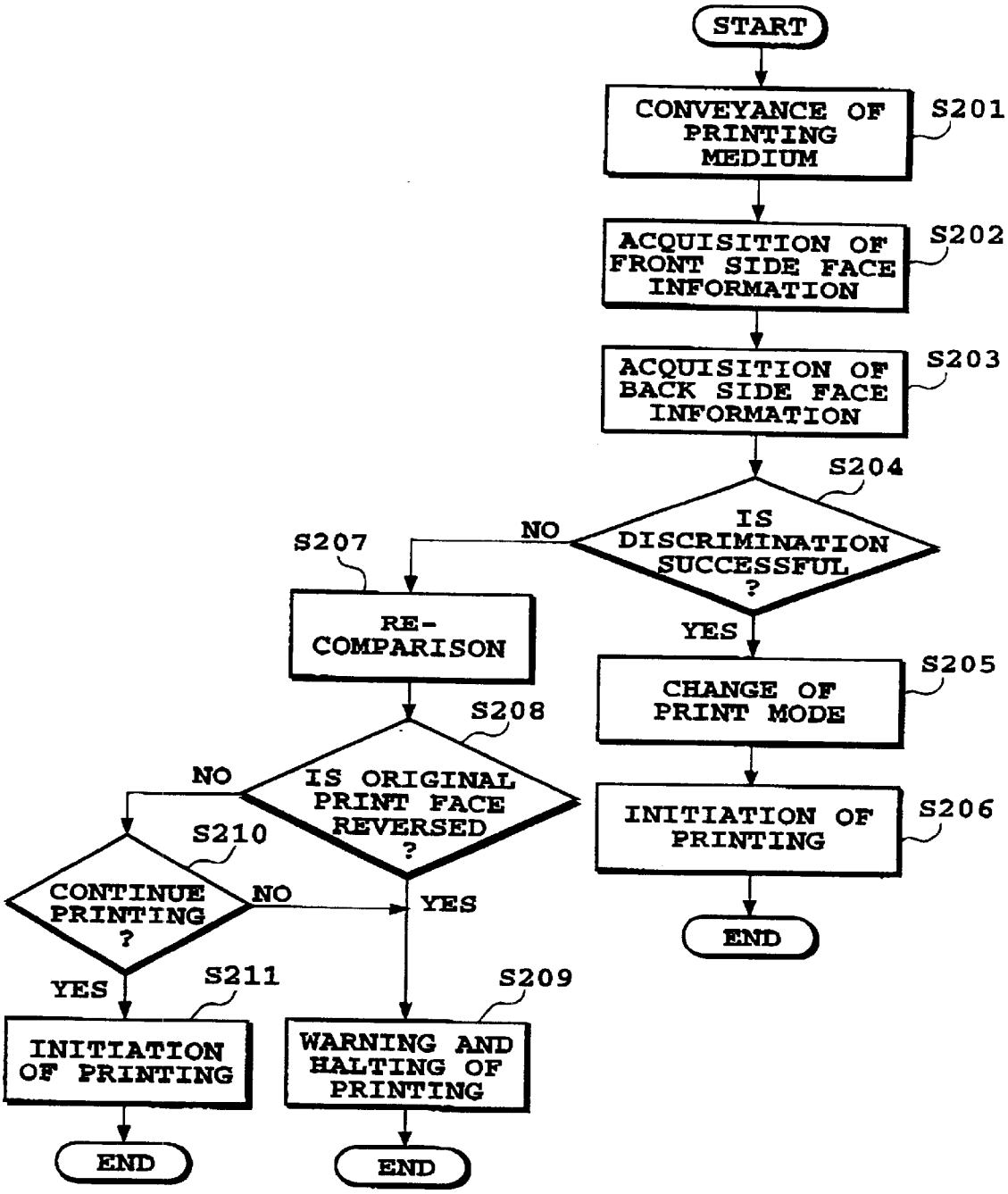
FIG. 3 is a flowchart showing one example of a procedure of printing processing by the apparatus of FIG. 1.

FIG. 3 is the flowchart showing one example of the procedure of printing processing by the apparatus of this embodiment.

The printing medium 104 loaded in the automatic sheet feeder 109 is fed toward the print position according to a print initiation instruction (step S201), and conveyed in the sub-scanning direction by the feed roller 108. Then, after the conveyance was started, the printing medium 104 is moved to a detection position of the reflection-type optical sensors 105, 106 and measurement of the reflectance of the front side face being opposed the print heads and being printed thereon (step S202) and measurement of the reflectance of the back side face (step S203) are conducted sequentially. The reason of not processing these at the same time is to prevent each sensor from receiving light irradiated by the other sensor with the light detection part thereof after the light passed through the printing medium 104.

Then, when it is judged from these acquired information that the type of printing medium is correctly discriminated and the medium is normally conveyed (step S204), a print mode control command part of the print command sent from the information processing unit 316 is subjected to rewriting according to the need (step S205). This rewriting according to the need means that an originally specified mode is changed to a mode that is in conformity to the printing medium being loaded, such as alteration setting of the ejection quantity etc., for example, in the case where the printing medium different from a specified printing medium is loaded or where the specified print mode is not proper. On the contrary, when the printing medium matches the specified print mode, the rewriting is unnecessary. At step S206, the printing is executed On the other hand, if the type of printing medium was not correctly discriminated, reference values corresponding to information acquired from the front side face and information acquired from the back side face are interchanged and the comparison is executed again (step S207). When the printing medium being loaded was discriminated to be in the state of a face on which the printing should be originally performed by the print heads (this face is referred as 'original print face', hereinafter) being reversed as a result of this (step S208), the apparatus gives the warning that the printing medium should be turned over and loaded, and halts the printing operation (step S209). On the contrary, if the printing medium was discriminated to be not in the state of the original print face being reversed as a result of re-comparison, that is, if proper discrimination was not able to be done for the printing medium being loaded, the judgment whether or not the printing should be executed is left to the user (step S210) and according to the user's judgment, the printing is halted (step S209) or the printing is executed in the print mode, just as it is, that is described by the code having been sent(step S211). Note that in performing the printing, alteration of the printing conditions may be done appropriately.

Figure 4:
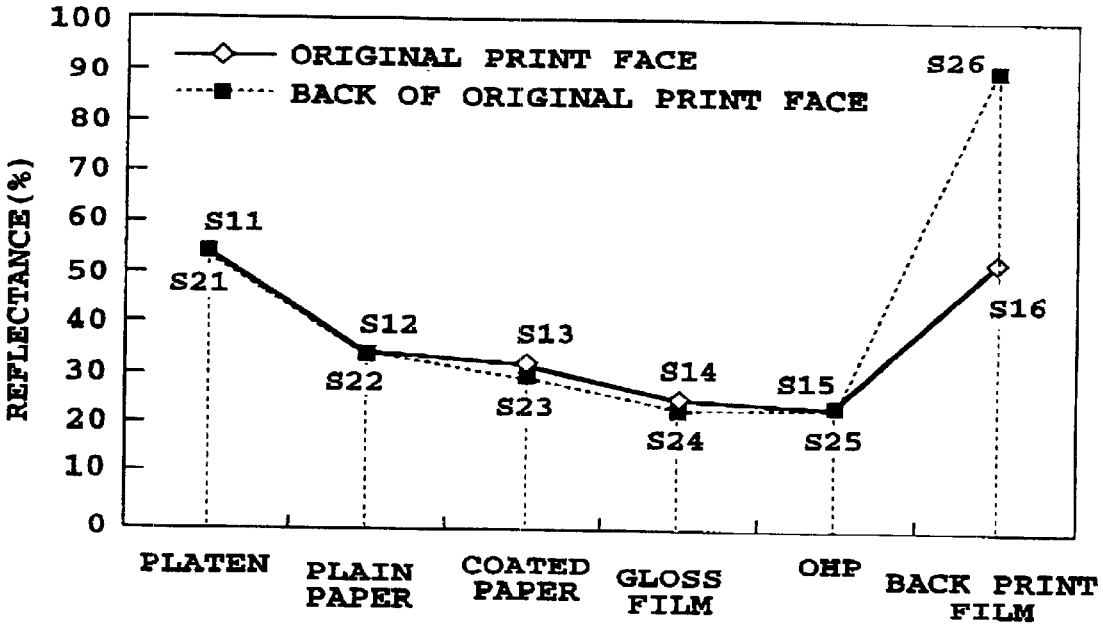
FIG. 4 is an explanatory diagram showing optical reflectances of the original print face and the back of the original print face for several types of printing media.

FIG. 4 shows a graph of the optical reflectances of the original print face and of the reverse face for several types of printing media. If only the reflectance of an original print face is paid attention to, it is not possible to discriminate the following pairs: the reflectance of a plain paper S12 and that of the original print face of a coated paper S13; the reflectance of the original print face of a gloss film S14 and that of an OHP film S15; the reflectance of the original print face of a back print film S16 and that of the platen S11. However, regarding the coated paper, the gloss film, and the back print film having been treated with coat processing only on one side thereof, the reflectances of the original print face and the back of the original print face are different from each other as is evident by comparing respective reflectances of the pairs with/without the coating layer: S13 and S23; S14 and S24; and S16 and S26.

Consequently, by measuring the front side face, the printing medium can be classified into three categories on the basis of the level of the reflectance: (1) the plain paper and the coated paper; (2) the gloss film and the OHP; (3) the back print film, assuming that the front side face is the original print face of the printing medium. In this occasion, any medium whose reflectance deviates largely from the previously-registered values of the reflectance table is judged as a discrimination error. Next, the reflectance of the back side face is measured, and by the difference of the reflectances of both of the faces, the type of printing medium can be discriminated finally. Also here, any medium whose reflectance deviates largely from the values of the reflectance table is judged as a discrimination error. Moreover, if the sign of the difference value of the reflectances of the front side face and of the back side face is opposite to the previously-registered content of the table, it can be judged that the printing medium is very likely to have been loaded in the sate of the original print face being reversed.

As described in the foregoing, according to the present embodiment, the type of printing medium can be discriminated with a high degree of accuracy by using two pieces of information obtained from both of the faces of the printing medium simultaneously, and consequently various printing conditions can be selected and set up properly without forcing the user to accomplish complicated operations at the time of initiating the printing. Moreover, even if the specification of the print mode is not proper, the printing-medium type discrimination device can make it possible for the printing apparatus to constantly perform the printing that is best suited to the printing medium. Furthermore, even when the printing medium is loaded in the state of the original print face being reversed, the discrimination can be conducted correctly and the result can be informed to the user.

Note that as means for obtaining information from both of the faces of the printing medium, the pair of optical sensors were used in this embodiment, but a form of the means is not limited to that of this embodiment and various forms can be used as will be exemplified in the following embodiments. In any embodiments, the same effect as that of this embodiment can be obtained.

Second Embodiment

In the same configuration as that of the first embodiment, an image pattern is used which is taken by an image pickup device as means for reading information of the front side face and the back side face of the printing medium.

For example, in the second embodiment according to the present invention, information of image patterns each of which presents a photographed construction state of fibers on the face of each printing medium is stored in the printing apparatus beforehand, matching of an image pattern that was read from the printing medium at the time of initiating the printing with these stored image patterns is confirmed, and the similar processing as that of the first embodiment is executed.

That is, the matching of the image patterns of the front side face and of the back side face with the stored patterns is confirmed, and for the printing medium whose type is discriminated, the print mode control command part of the print command, having been sent from the information processing unit 316, is re-written if necessary and the printing operation is executed. On the contrary, when the matching was not able to be confirmed, the reference image pattern for the front side face and that for the back side face are interchanged, the matching with the stored reference image patterns is confirmed again, and when both of the image patterns agree with the stored image patterns, the printing medium is very likely to be loaded in the state of the print face being the other side, and consequently the device gives the user the warning and halts the printing. On the contrary, when the image patterns are not consistent with any of the stored patterns at all, the apparatus either halts the printing or executes the printing in a print mode described in the code having been sent, according to the user's judgment.

Third Embodiment

In the same configuration as that of the first embodiment, means for measuring friction force is employed as the, reading means for reading information of the front side face and the back side face of the printing medium. This means for measuring friction force may be one that comprises a part making a contact with the printing medium while the printing medium is being conveyed and means for detecting displacement of the above-mentioned part in accordance with the surface state of the printing medium Further, the means for measuring friction force is expected to be arranged on both sides of the front side and the back side of a conveyance path of the printing medium.

For example, in the third embodiment according to the present invention, values of the friction force table for respective printing media are stored beforehand in the printing apparatus, friction forces being read from the printing medium are compared with these values at the time of initiating the printing, and then the similar processing as that of the first embodiment is executed.

That is, for the printing medium such that friction forces of the front side face and of the back side face accord with certain values in the table and the type thereof is discriminated, the print mode control command part of the print command having been sent from the information processing unit 316 is re-written if necessary and then the printing is executed. On the other hand, if the accordance is not obtained, the friction force data in the table for the front side face and that of the back side face are interchanged and the comparison is executed again. When the values of friction force for both faces are consistent with the table data, the printing medium is very likely to be loaded in the state of the print f ace being reversed and consequently the device gives the user the warning and halts the printing. On the contrary, when the measured friction forces and table values are not consistent with each other at all, the device either halts the printing or executes the printing in a print mode described in the code having been sent, according to the user's judgment.

Fourth Embodiment

In the same configuration as that of the first embodiment, the reading means for reading information of the type of printing medium uses information presented by each printing medium. For example, in the case where the sprinting medium itself bears its inherent information on the original print face thereof, for example, a figure drawn with an ink whose optical reflectance varies according to each type of printing medium, in the fourth embodiment according to the present invention, the information is read with an optical sensor. Then, by recognizing the printing medium referring to figure data and reflectance data registered in the printing apparatus beforehand, the type of the printing medium is discriminated and the similar processing as that of the first embodiment is executed.

That is, for the printing medium such that the figure was read from the front side face thereof and the type thereof was discriminated, the print mode control command part of the print command having been sent from the information processing unit 316 is rewritten if necessary and the printing operation Is executed. If the discrimination of the printing medium was unsuccessful, the information of the front side face and of the back side face are interchanged and the comparison is executed again to recognize the figures. When the figure to be referred was found to exist on the back side face, the apparatus gives the user the warning and halts the printing because the printing medium is very likely to be loaded in the state of the original print face being reversed. On the contrary, when the figure was not able to be recognized and the discrimination of the printing medium was unsuccessful, the device either halts the printing or executes the printing in a print mode described in the code having been sent, according to the user's judgment.

Note that where the figure is provided on the original print face, it is preferable that the figure is provided on such a position (e.g. on a part along with an edge of the printing medium) that quality degradation of the printed image is not observed and/or that the figure is formed with a color having such reflectance that the quality degradation of the printed image is not observed. Further, the figure may be provided on the back side face, and such a method can eliminate many of constraints imposed on the case where the figure is provided on the original print face.

Others

In addition, the present invention can be applied not only to the printing apparatus of the ink jet method but also to the printing apparatuses of other methods as long as there is a fear that a difference of the quality would occur between the formed images even under the same conditions due to the relationship between the characteristic of the print agents and the type of printing medium.

However, in the case that an ink jet printing method is applied, the present invention achieves distinct effect when applied to a print head or a printing apparatus which has means for generating thermal energy such as electrothermal transducers or laser light, and which causes changes in ink by the thermal energy so as to eject ink. This is because such a system can achieve a high density and high resolution printing.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet printing systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to printing information; second, the thermal energy induces sudden temperature rise that exceeds the nucleate boiling so as to cause the film boiling on heating portions of the print head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better printing.

U.S. Pat. Nos. 4,558,333 and 4,459,600 disclose the following structure of a print head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 59-123670 (1984) and 59-138461 (1984) in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the print head, the present invention can achieve printing positively and effectively.

The present invention can be also applied to a so-called full-line type print head whose length equals the maximum length across a printing medium. Such a print head may consists of a plurality of print heads combined together, or one integrally arranged print head.

In addition, the present invention can be applied to various serial type print heads: a print head fixed to the main assembly of a printing apparatus; a conveniently replaceable chip type print head which, when loaded on the main assembly of a printing apparatus, is electrically connected to the main assembly, and is supplied with ink therefrom; and a cartridge type print head integrally including an ink reservoir.

It is further preferable to add a recovery system, or a preliminary auxiliary system for a print head as a constituent of the printing apparatus because they serve to make the effect of the present invention more reliable. Examples of the recovery system are a capping means and a cleaning means for the print head, and a pressure or suction means for the print head. Examples of the preliminary auxiliary system are a preliminary heating means utilizing electrothermal transducers or a combination of other heater elements and the electrothermal transducers, and means for carrying out preliminary ejection of ink independently of the ejection for printing. These systems are effective for reliable printing.

The number and type of print heads to be mounted on a printing apparatus can be also changed. For example, only one print head corresponding to a single color ink, or a plurality of print heads corresponding to a plurality of inks different in color or concentration can be used. In other words, the present invention can be effectively applied to an apparatus having at least one of the monochromatic, multi-color and full-color modes. Here, the monochromatic mode performs printing by using only one major color such as black. The multi-color mode carries out printing by using different color inks, and the full-color mode performs printing by color mixing.

Furthermore, although the above-described embodiments use liquid ink, inks that are liquid when the printing signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the printing medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the printing signal. In such cases, the ink may be retained in recesses or through holes formed in a porous sheet as liquid or solid substances so that the ink faces the electrothermal transducers as described in Japanese Patent Application Laying-open Nos. 54-56847 (1979) or 60-71260 (1985). The present invention is most effective when it uses the film boiling phenomenon to expel the ink.

Furthermore, the ink jet printing apparatus of the present invention can be employed not only as an image output terminal of an information processing device such as a computer, but also as an output device of a copying machine including a reader, and as an output device of,a facsimile apparatus having a transmission and receiving function.

Further, the present invention may be applied to a system consisting of a plurality of devices (e.g., a host computer, interface devices, a reader, a printer, etch) and also may be applied to an apparatus consisting of only one device (e.g., a copier, a facsimile, etc.).

Moreover, the scope of the present invention also includes a print system in which program codes of software or printer driver that realize the function of the above embodiment are supplied to the computer in a machine or system to which various devices including the printing apparatus are connected, and in which the program code stored in the computer in the machine or system are executed to operate a variety of devices, thereby realizing the function of the above-described embodiment.

In this case, the program codes themselves realize a novel function of the present invention and therefore the program codes themselves and means to supply the program code to the computer, such as storage media, are also included in the scope of this invention.

The storage media to supply the program codes include, for example, floppy disks, hard disks, optical disks, CD-ROMs, CD-Rs, magnetic tapes, nonvolatile memory cards and ROMs.

The scope of this invention includes not only a case where the function of the above-described embodiment is realized by executing the program codes read by the computer but also a case where an operating system running on the computer performs, according to directions of the program codes, a part or all of the actual processing and thereby realizes the function of this embodiment.

Further, the scope of this invention includes a case where the program codes read from a storage medium are written into a memory in a function expansion board inserted in the computer or into a memory in a function expansion unit connected to the computer, after which, based on directions of the program codes, a CPU in the function expansion board or function expansion unit executes a part or all of the actual processing and thereby realizes the function of this embodiment.

As described in the foregoing, according to the present invention, by using information obtained from both faces of the printing medium, the type of printing medium can be discriminated with a high degree of accuracy compared to a case where information of one face is acquired as in the conventional case, whereby various printing conditions can be properly selected and set up without forcing the user to accomplish complicated operations at the time of initiating the printing. Further, even if a specified print mode is not proper, the printing that is best suited to the printing medium can be executed constantly.

Moreover, even if the printing medium is loaded in the state of the original print face being reversed, the discrimination can be conducted correctly and the result can be informed to the user.

The present invention has been described in detail with respect to a preferred embodiment, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A printing-medium type discrimination device applied to a printing apparatus for performing printing on a printing medium, comprising:

means for acquiring information of both a front side face, on which the printing will be executed, and a back side face of the printing medium; and means for discriminating the type of the printing medium through the use of the acquired information.

2. A printing-medium type discrimination device as claimed in claim 1, wherein said discriminating means conducts discrimination through the use of reference values for the acquired information.

3. A printing-medium type discrimination device as claimed in claim 1, wherein said discriminating means conducts discrimination through the use of reference values for the acquired information and a difference value between the acquired information of the front side face and the back side face of the printing medium.

4. A printing-medium type discrimination device as claimed in claim 1, wherein said information acquisition means has means for irradiating each of the faces of the printing medium with light and measuring the quantity of reflected light obtained therefrom.

5. A printing-medium type discrimination device as claimed in claim 1, wherein said information acquisition means has an image pickup device for reading respective patterns of the faces of the printing medium.

6. A printing-medium type discrimination device as claimed in claim 1, wherein said information acquisition means has means for measuring respective friction forces of the faces of the printing medium.

7. A printing-medium type discrimination device as claimed in claim 1, wherein said information acquisition means has means for reading inherent information that has been formed on one of the faces of the printing medium beforehand.

8. A printing medium that bears information concerning its own type thereon, wherein said information is provided at a position that can be read by means for acquiring information of both a front side face, on which printing will be executed, and a back side face of the printing medium.

9. A printing apparatus for performing printing on a printing medium by using a print head, comprising:

means for acquiring information of both a front side face, on which the printing will be executed, and a back side face of the printing medium;

means for discriminating the type of the printing medium through the use of the acquired information; and means for executing the printing that is suited to the printing medium on which the printing is to be executed according to the discrimination of said discriminating means.

10. A printing apparatus as claimed in claim 9, wherein said printing execution means has means for changing a specified print mode according to the discriminated printing medium type.

11. A printing apparatus as claimed in claim 9, further comprising means for judging whether or not the printing medium is loaded such that the face on which the printing should be originally performed is reversed, through the use of the acquired information, when said printing-medium type discrimination means fails to conduct the discrimination.

12. A printing apparatus as claimed in claim 9, further comprising:

means for providing a user with predetermined information and halting the printing when said discriminating means judges the printing medium to be loaded such that the face on which the printing should be originally performed is reversed; and means for continuing or halting the printing according to the user's instruction indicating whether the printing is to be continued or not, when the judgement regarding the face on which the printing should be originally performed being reversed is not made.

13. A printing apparatus as claimed in claim 9, wherein said print head is an ink jet print head for ejecting an ink as a print agent to the printing medium.

14. A printing apparatus as claimed in claim 13, wherein said ink jet print head has an electrothermal transducer to generate thermal energy for causing film boiling in the ink to eject the ink.

15. A printing system, comprising:

a printing apparatus having means for acquiring information of both a front side face, on which printing will be executed, and a back side face of a printing medium, means for discriminating the type of the printing medium through the use of the acquired information, and means for executing the printing that is suited to the printing medium on which the printing is to be executed according to the discrimination of said discriminating means; and an image data supplying apparatus for supplying image data to be printed to said printing apparatus.

16. A printing-medium type discrimination method applied to a printing apparatus for performing printing on a printing medium, comprising the steps of:

acquiring information of both a front side face, on which the printing will be executed, and a back side face of the printing medium; and discriminating the type of the printing medium through the use of the acquired information.

17. A method for discriminating a printing medium as claimed in claim 16, wherein said discriminating step conducts discrimination through the use of reference values for the acquired information.

18. A method for discriminating a printing medium as claimed in claim 16, wherein said discriminating step conducts discrimination through the use of reference values for the acquired information and a difference value between the acquired information of the front side face and the back side face of the printing medium.

19. A method for discriminating a printing medium as claimed in claim 16, wherein said information acquisition step includes the steps of irradiating each of the faces of the printing medium with light and measuring the quantity of reflected light obtained therefrom.

20. A method for discriminating a printing medium as claimed in claim 16, wherein said information acquisition step includes a step of reading respective patterns of the faces of the printing medium.

21. A method for discriminating a printing medium as claimed in claim 16, wherein said information acquisition step includes a step of measuring respective friction forces of the faces of the printing medium.

22. A method for discriminating a printing medium as claimed in claim 16, wherein said information acquisition step includes a step of reading inherent information that has been formed on one of the faces of the printing medium beforehand.

23. A printing method for performing printing on a printing medium by using a print head, comprising the steps of:

acquiring information of both a front side face, on which the printing will be executed, and a back side face of the printing medium;

discriminating the type of the printing medium through the use of the acquired information; and executing the printing that is suited to the printing medium on which the printing is to be executed according to the discrimination.

24. A printing method as claimed in claim 23, wherein said printing execution step includes a step of changing a specified print mode according to the discriminated printing medium type.

25. A printing method as claimed in claim 23, further comprising the steps of:

judging whether or not the printing medium is loaded such that the face on which the printing should be originally performed is reversed, through the use of the information acquired in the acquisition step, when said discrimination step fails to conduct the discrimination.

26. A printing method as claimed in claim 23, further comprising the steps of:

providing a user with predetermined information and halting the printing when said discriminating step judges the printing medium to be loaded such that the face on which the printing should be originally performed is reversed; and continuing or halting the printing according to the user's instruction indicating whether the printing is to be continued or not, when the judgement regarding the face on which the printing should be originally performed being reversed is not made.

27. A printing method applied to a printing system comprising an image data supplying apparatus and a printing apparatus, said method comprising the steps of:

supplying image data to be printed to said printing apparatus from said image data supplying apparatus;

acquiring information of both a front side face, on which the printing will be executed, and a back side face of a printing medium before printing of said image data;

discriminating the type of the printing medium through the use of the acquired information; and executing the printing that is suited to the printing medium on which the printing is to be executed according to the discrimination.

28. A program for performing a printing-medium type discrimination method applied to a printing apparatus, said method comprising the steps of:

acquiring information of both a front side face, on which printing will be executed, and a back side face of a printing medium; and discriminating the type of the printing medium through the use of the acquired information.

29. A program for performing a printing method for executing printing on a printing medium by using a print head, said method comprising the steps of:

acquiring information of both a front side face, on which the printing will be executed, and a back side face of the printing medium;

discriminating the type of the printing medium through the use of the acquired information; and executing the printing that is suited to the printing medium on which the printing is to be executed according to the discrimination.

30. A program for performing a printing method applied to a printing system comprising an image data supplying apparatus and a printing apparatus, said method comprising the steps of:

supplying image data to be printed to said printing apparatus from said image data supplying apparatus;

acquiring information of both a front side face, on which the printing will be executed, and a back side face of a printing medium before printing of said image data;

discriminating the type of the printing medium through the use of the acquired information; and executing the printing that is suited to the printing medium on which the printing is to be executed according to the discrimination.

* * * * *

UNITED STATES PATENT AND TRADEMARK OFFICE

CERTIFICATE OF CORRECTION

PATENT NO. : 6,520,614 B2 
DATED : February 18, 2003
INVENTOR(S) : Kaneko

It is certified that error appears in the above-identified patent and that said Letters Patent is hereby corrected as shown below:

Column 2,
Line 66, “In” should read -- in --.

Column 5,
Lines 55 and 56, should be merged into one paragraph.

Column 7,
Line 21, “these” should read -- this --.

Column 9,
Line 51, “f ace” should read -- face --; and
Line 64, “sprinting” should read -- printing --.

Column 12,
Line 30, “of, a” should read -- of a --; and
Line 34, “etch)” should read -- etc.) --.

Signed and Sealed this

Eighteenth Day of November, 2003

JAMES E. ROGAN
*Director of the United States Patent and Trademark Office*